United States Patent [19]

Bunger et al.

[11] Patent Number: 5,060,953

[45] Date of Patent: Oct. 29, 1991

[54] GOLF BALL

[75] Inventors: Donald J. Bunger, Waterbury, Conn.; Joseph F. Stiefel, Ludlow, Mass.

[73] Assignee: Spalding & Evenflo Companies, Inc., Tampa, Fla.

[21] Appl. No.: 642,989

[22] Filed: Jan. 18, 1991

[51] Int. Cl.[5] ..... A63B 37/14

[52] U.S. Cl. ..... 273/232; 40/327

[58] Field of Search ..... 273/232, 62, 220, 218; 40/327; D21/205

[56] References Cited

U.S. PATENT DOCUMENTS

| | | | |
|---|---|---|---|
| Re. 25,427 | 7/1963 | Harkins | 273/230 |
| D. 107,066 | 11/1937 | Cavignac | 273/232 X |
| D. 228,394 | 9/1973 | Martin et al. | D34/5 QQ |
| D. 243,866 | 3/1977 | Shaw et al. | D34/5 QQ |
| D. 247,685 | 4/1978 | Haines et al. | D34/5 QQ |
| 878,254 | 2/1908 | Taylor | 273/232 |
| 906,932 | 12/1908 | Riblet | 273/233 |
| 922,773 | 5/1909 | Kempshall | 273/232 |
| 985,741 | 2/1911 | Harvey | 273/220 |
| 1,182,605 | 5/1916 | Wadsworth | 273/232 |
| 1,265,036 | 7/1918 | Bendelow | 273/233 |
| 1,286,834 | 12/1918 | Taylor | 273/232 |
| 1,418,220 | 5/1922 | White | 273/232 |
| 1,482,232 | 1/1924 | Hazeltine | 273/232 |
| 1,656,408 | 1/1928 | Young | 273/232 |
| 1,666,699 | 4/1928 | Hagen | 273/232 |
| 1,681,167 | 8/1928 | Beldam | 273/232 |
| 1,716,435 | 6/1929 | Fotheringham | 273/232 |
| 1,855,448 | 4/1932 | Hazeltine | 273/232 |
| 2,002,726 | 5/1935 | Young | 273/62 |
| 2,106,704 | 2/1938 | Davis | 273/62 |
| 2,643,125 | 6/1953 | Juve | 273/235 |
| 2,728,576 | 12/1955 | Martin et al. | 273/232 |
| 2,730,159 | 1/1956 | Semegen | 273/233 X |
| 2,741,480 | 4/1956 | Smith | 273/227 |
| 2,861,810 | 11/1958 | Veatch | 273/213 |
| 2,997,302 | 8/1961 | Smith | 273/235 |
| 3,031,194 | 4/1962 | Strayer | 273/213 |
| 3,819,190 | 6/1974 | Nepela et al. | 273/232 |
| 3,940,145 | 2/1976 | Gentiluomo | 273/218 |
| 4,090,716 | 5/1978 | Martin et al. | 273/232 |
| 4,141,559 | 2/1979 | Melvin et al. | 273/220 |
| 4,142,727 | 3/1979 | Shaw et al. | 273/232 |
| 4,235,441 | 11/1980 | Ciccarello | 273/213 |
| 4,256,304 | 3/1981 | Smith et al. | 273/60 B |
| 4,258,921 | 3/1981 | Worst | 273/232 |
| 4,266,773 | 5/1981 | Treadwell | 273/232 |
| 4,284,276 | 8/1981 | Worst | 273/232 |
| 4,346,898 | 8/1982 | Badke | 273/232 |
| 4,560,168 | 12/1985 | Aoyama | 273/232 |
| 4,653,758 | 3/1987 | Solheim | 273/232 |
| 4,660,834 | 4/1987 | Carrigan | 273/176 AB |
| 4,681,323 | 7/1987 | Alaki et al. | 273/232 |

(List continued on next page.)

FOREIGN PATENT DOCUMENTS

| | | | |
|---|---|---|---|
| 4774 | of 1892 | United Kingdom | 273/62 |
| 4360 | of 1898 | United Kingdom | 273/232 |
| 20778 | of 1911 | United Kingdom | 273/232 |
| 3012 | of 1912 | United Kingdom | 273/232 |
| 22179 | of 1912 | United Kingdom | 273/232 |

(List continued on next page.)

*Primary Examiner*—George J. Marlo

*Attorney, Agent, or Firm*—Donald R. Bahr; John E. Benoit

[57] ABSTRACT

A golf ball is provided having a dimpled surface, the configuration of the dimples comprising a dimple-free equatorial line on the ball dividing the ball into two hemispheres, with each hemisphere having substantially identical dimple patterns. The dimple pattern of each hemisphere comprises a first plurality of dimples extending in at least two spaced clockwise arcs between the pole and the equator of each hemisphere, a second plurality of dimples extending in at least two spaced counterclockwise arcs between the pole and the equator of each hemisphere, and a third plurality of dimples substantially filling the surface area between the first and second plurality of dimples.

35 Claims, 9 Drawing Sheets

U.S. PATENT DOCUMENTS

| | | | |
|---|---|---|---|
| 4,720,111 | 1/1988 | Yamada | 273/232 |
| 4,722,529 | 2/1988 | Shaw et al. | 273/232 |
| 4,729,567 | 3/1988 | Oka et al. | 273/232 |
| 4,729,861 | 3/1988 | Lynch et al. | 264/219 |
| 4,744,564 | 5/1988 | Yamada | 273/232 |
| 4,762,326 | 8/1988 | Gobush | 273/232 |
| 4,765,626 | 8/1988 | Gobush | 273/232 |
| 4,772,026 | 9/1988 | Gobush | 273/232 |
| 4,787,638 | 11/1988 | Kobayashi | 273/232 |
| 4,804,189 | 2/1989 | Gobush | 273/232 |
| 4,813,677 | 3/1989 | Oka et al. | 273/232 |
| 4,830,378 | 5/1989 | Aoyama | 273/232 |
| 4,840,381 | 6/1989 | Ihara et al. | 273/232 |
| 4,844,472 | 7/1989 | Ihara | 273/232 |
| 4,848,766 | 7/1989 | Oka et al. | 273/232 |
| 4,858,923 | 8/1989 | Gobush et al. | 273/62 |
| 4,867,459 | 9/1989 | Ihara | 273/232 |
| 4,869,512 | 9/1989 | Nomura et al. | 273/232 |
| 4,877,252 | 10/1989 | Shaw | 273/232 |
| 4,880,241 | 11/1989 | Melvin et al. | 273/232 |
| 4,886,277 | 12/1989 | Mackey | 273/232 |
| 4,915,389 | 4/1990 | Ihara | 273/232 |
| 4,915,390 | 4/1990 | Gobush et al. | 273/232 |
| 4,921,255 | 5/1990 | Taylor | 273/232 |
| 4,925,193 | 5/1990 | Melvin et al. | 273/232 |
| 4,932,664 | 6/1990 | Pocklington et al. | 273/232 |
| 4,936,587 | 6/1990 | Lynch et al. | 273/232 |
| 4,949,976 | 8/1990 | Gobush | 273/232 |
| 4,960,283 | 10/1990 | Gobush | 273/232 |

FOREIGN PATENT DOCUMENTS

| | | | |
|---|---|---|---|
| 645 | 1/1914 | United Kingdom | 273/232 |
| 189551 | 9/1921 | United Kingdom | 273/232 |
| 377354 | 5/1931 | United Kingdom | 273/232 |
| 420410 | 1/1934 | United Kingdom | 273/62 |

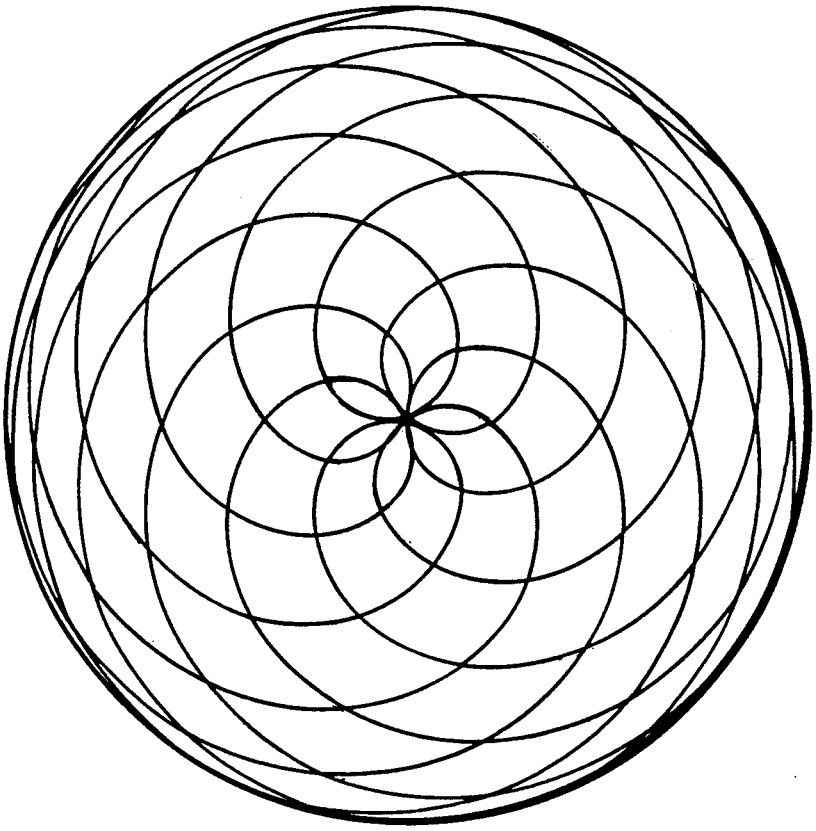
FIG. 11
FIG. 12
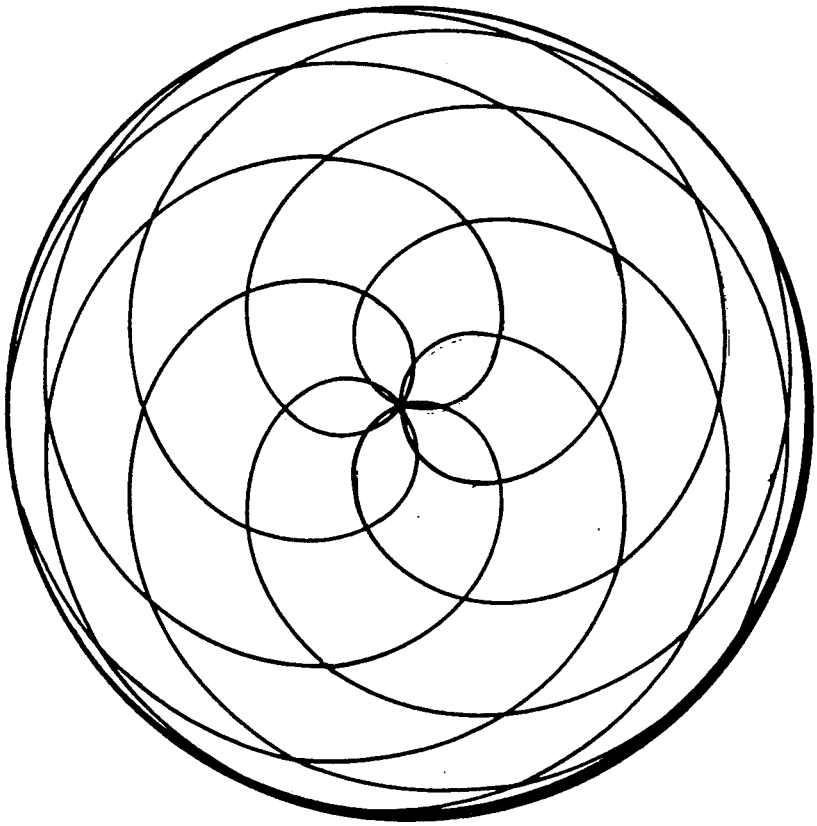

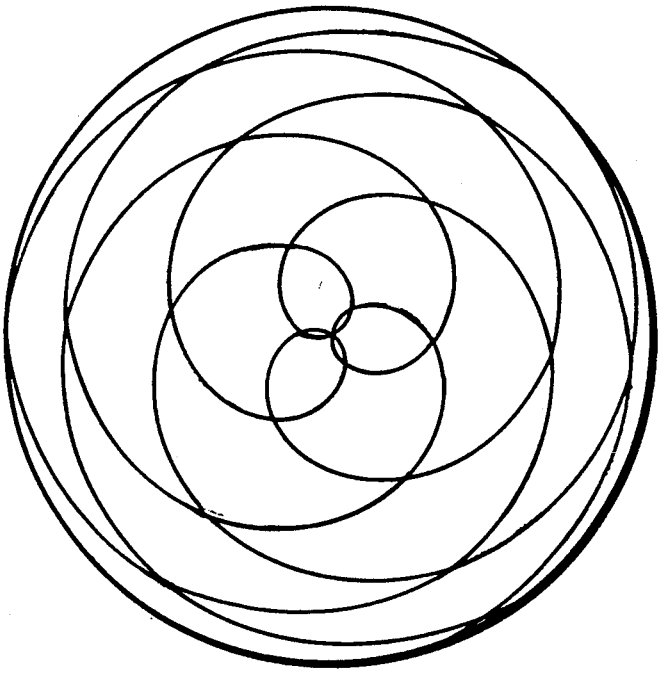
FIG. 17
FIG. 18
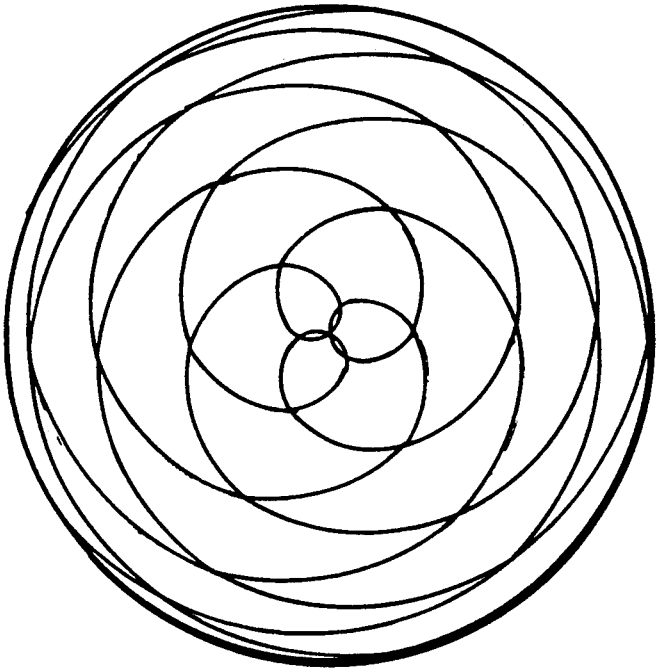
FIG. 19
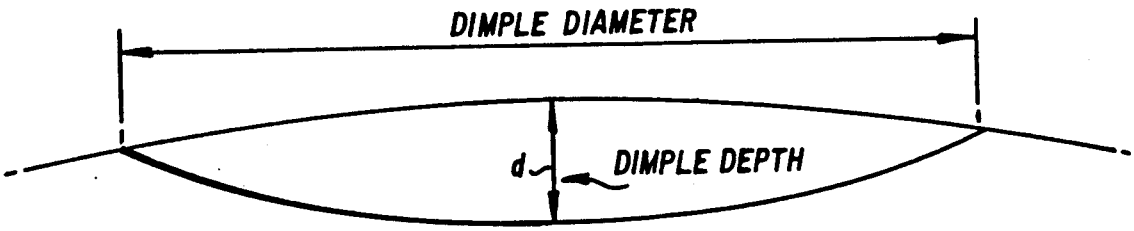

GOLF BALL

This invention relates generally to golf balls and more particularly to the arrangement of dimples on a golf ball and the method of arranging such dimples.

Dimples are used on golf balls as a standard means for controlling and improving the flight of the golf ball. One of the basic criteria for the use of dimples is to attempt to cover the maximum surface of the ball with dimples without incurring any detrimental effects which would influence the aerodynamic symmetry of the ball. Such aerodynamic symmetry is necessary in order to satisfy the requirements of the United States Golf Association (U.S.G.A.). Aerodynamic symmetry means that the ball must fly substantially the same with little variation no matter how it is placed on the tee or on the ground.

In British Patent Provisional Specification Serial No. 377,354, filed May 22, 1931, in the name of John Vernon Pugh, there is disclosed various triangular configurations which may be used to establish dimple patterns that are geometrical and which would also be aerodynamically symmetrical. Pugh uses a number of geometrical patterns wherein he inscribes a regular polyhedron of various types in order to provide such symmetry. The details of plotting and locating the dimples is described in the above-mentioned provisional specification.

The problem arises with the Pugh icosahedral golf ball in that there is no equatorial line on the ball which does not pass through some of the dimples. Since golf balls are molded and manufactured by two hemispherical half molds normally having straight edges, the ball as it comes from the mold has a flash line about the equatorial line created by the two hemispheres of the mold. Even if the ball could be molded with dimples on the flash line, the ball could not be properly cleaned and finished in any efficient manner since the flash could not be cleaned from the bottom of the dimple without individual treatment of each dimple.

Many proposals have been made and, in fact, many balls have been produced using modifications of the Pugh polyhedron concept, which leave an equatorial dimple-free line and still substantially maintain aerodynamic symmetry.

Other various proposals have been made and balls have been conformed which use differing means for locating the dimples on a golf ball. One such means is the use of a plurality of great circles about the ball, which great circles form triangles which include the dimples to be used on the golf ball. Again, these balls provide for an equatorial line free of dimples so that they may be molded.

There is a constant striving for dimple configurations which provide the necessary aerodynamic symmetry and which still allow for the maximum surface coverage on the golf ball.

Accordingly, it is an object of the present invention to provide a golf ball having dimples on the surface which assume a unique symmetry about the surface of the ball so that the ball will fly equally well regardless of its position on the tee.

It is also an object of this invention to provide a method for locating dimples on the surface of a ball so as to achieve aerodynamic symmetry.

Yet another object of the invention is to use a surface pattern for locating dimples on a golf ball which includes opposed arcs extending clockwise and counterclockwise between the pole and equator of the ball.

These and other objects of the invention will become obvious from the following description taken together with the drawings.

BRIEF SUMMARY OF THE INVENTION

A golf ball is provided having a dimpled surface, the configuration of the dimples comprising a dimple-free equatorial line on the ball dividing the ball into two hemispheres, with each hemisphere having substantially identical dimple patterns. The dimple pattern of each hemisphere comprises a first plurality of dimples extending in at least two spaced clockwise arcs between the pole and the equator of each hemisphere, a second plurality of dimples extending in at least two spaced counterclockwise arcs between the pole and the equator of each hemisphere, and a third plurality of dimples substantially filling the surface area between said first and second pluralities of dimples.

BRIEF DESCRIPTION OF THE DRAWINGS

FIGS. 10–18 disclose some alternate arcuate configurations for providing further embodiments of the golf ball as disclosed in FIG. 9; and FIG. 19 is a schematic showing of the measurement of dimple depth and diameter.

DETAILED DESCRIPTION OF THE PREFERRED EMBODIMENTS

The drawings basically show a dimpled ball and a method for providing the dimple configuration of the present invention on the surface of a golf ball. It is to be stressed that the primary consideration in the basic concept of dimple configuration and all of the embodiments resulting therefrom is directed to the aspect of dimple symmetry so that the ball will have the necessary aerodynamic symmetry in flight regardless of its position on the tee or ground. FIGS. 1–9 disclose one embodiment of the present invention.

Figure 1:
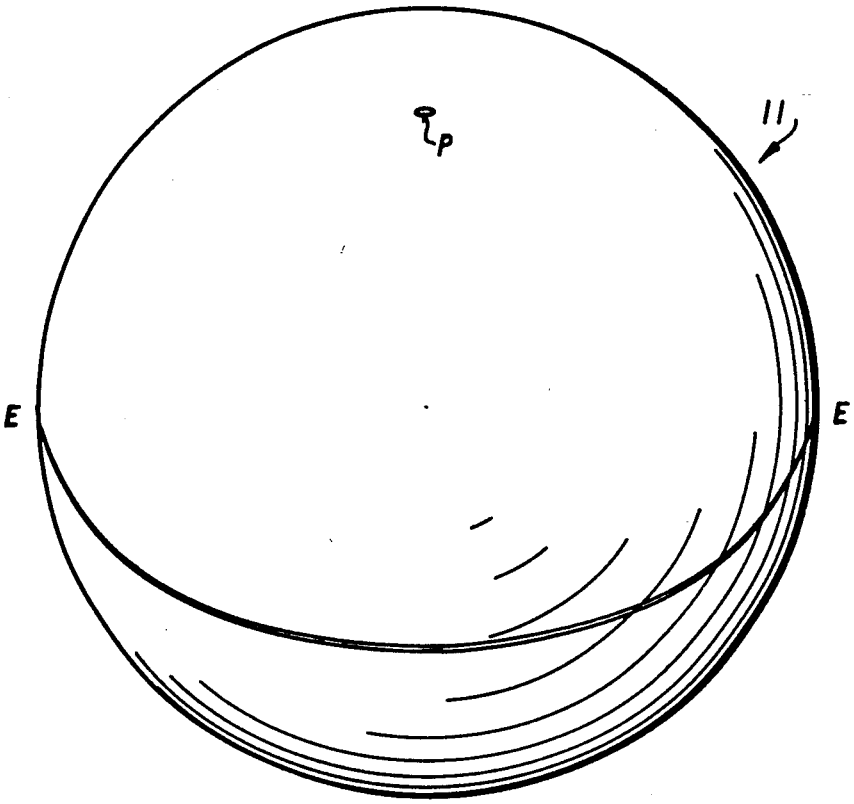
FIG. 1 is a view of a golf ball along an offset line from the equator line of the ball indicating the pole position.

Referring to FIG. 1, there is shown a basic golf ball 11 having a surface which has no dimples thereon. In approaching the dimple configuration, one begins with an equatorial line E—E which in all cases must be dimple-free. This equatorial line obviously creates a pole P at the top and the bottom of the ball.

The basic concept of the present invention is to use sets of arcuate lines extending between the pole and the equator on each hemisphere of the ball. In order to obtain the symmetry desired, both hemispheres have dimple configurations which are substantially identical. FIGS. 1–9 show the development of one specific dimple configuration, resulting in one embodiment of the present invention. In this particular configuration, four sets of opposing clockwise and counterclockwise arcs are used to establish the basic dimple pattern.

Figure 2:
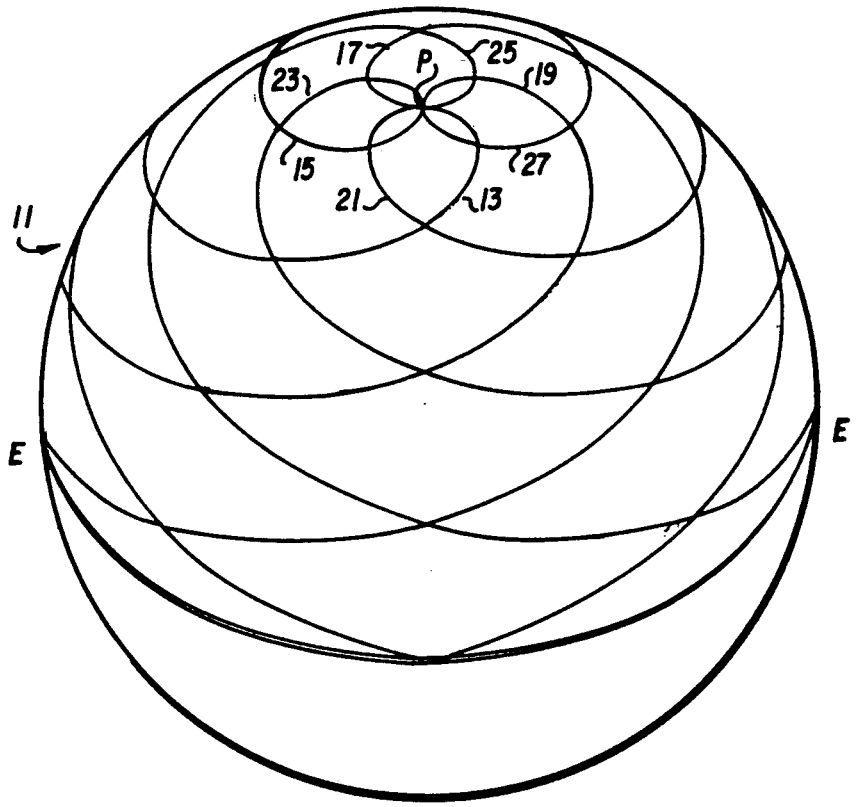
FIG. 2 is a showing of the ball of FIG. 1 with the arcuate clockwise and counterclockwise lines drawn on the surface thereof.
Figure 3:
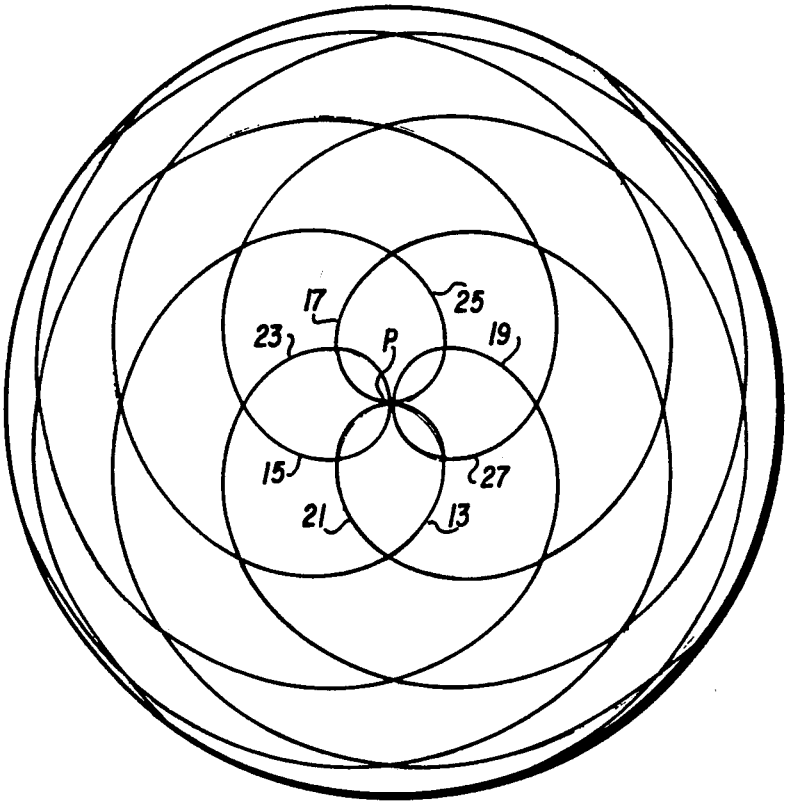
FIG. 3 is a polar view of the ball of FIG. 2.
Figure 4:
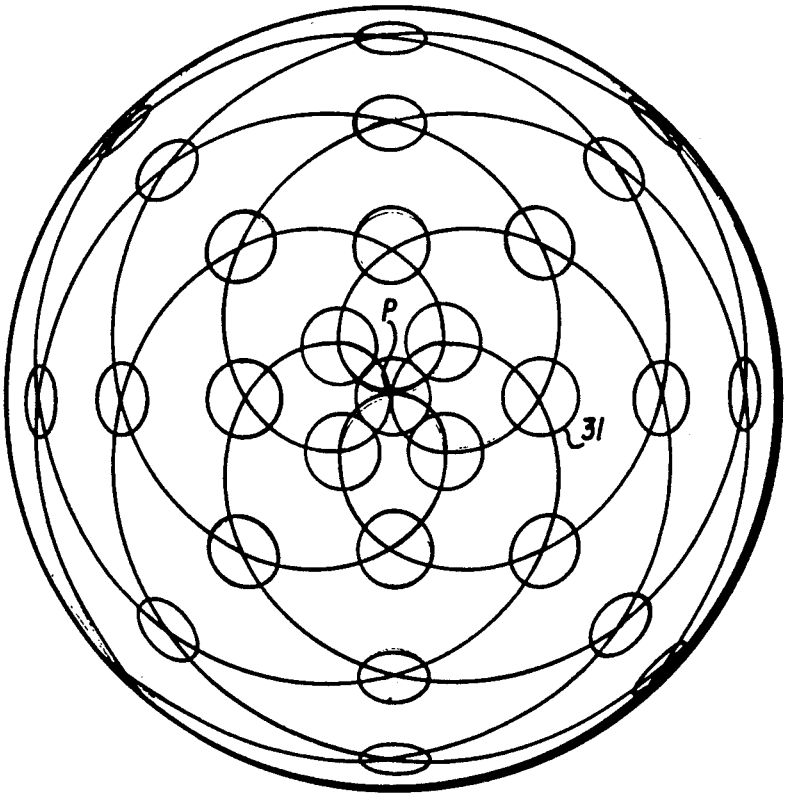
FIG. 4 is a polar view of the ball of FIG. 3 showing the location of dimples at the crossing points of the arcuate lines.

As shown in FIG. 2, four arcs 13, 15, 17, and 19 originate at pole P and extend clockwise about the surface of the hemisphere and terminate at equator E—E. Four counterclockwise arcs 21, 23, 25, and 27 extend in like manner and equivalent arcuate configuration counterclockwise about the hemisphere of the ball from pole P to equator E—E. FIG. 3 shows a polar view of the arcs shown in FIG. 2.

In order to obtain symmetry, the present invention provides that dimples be placed along the lines of the arcs extending between pole P and equator E—E.

While various approaches could be taken to commence with the arrangement of these dimples, it is preferable that the dimples be originally located at each point wherein the clockwise and counterclockwise arcs intersect. This is specifically shown in FIG. 4, wherein dimples 31, all having the same diameter, have been placed so that their centers are substantially over the intersecting points of the arcs.

Figure 5:
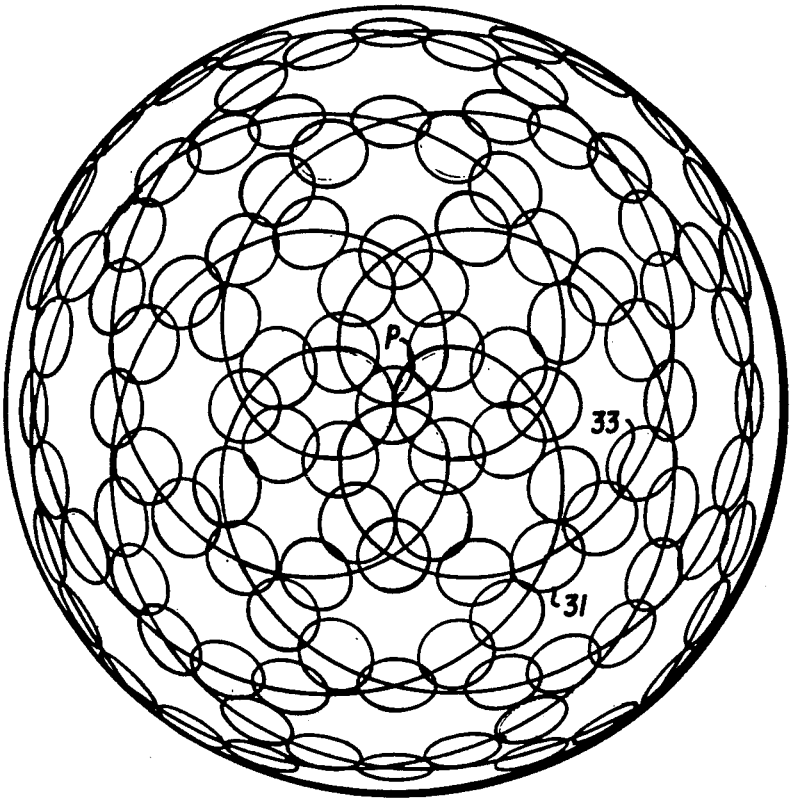
FIG. 5 is a polar view of the ball of FIG. 4 having additional dimples added along the arcuate lines.

Referring to FIG. 5, additional dimples are added to the lines so that they substantially fill the arcs with dimples between pole P and equator E—E. As can be seen from FIG. 5, use of dimples of the same size will result in overlapping dimples such as indicated at 33. Although overlapping dimples may be used, it is preferable to cover the maximum amount of the surface of the ball while eliminating most or all such overlaps.

Figure 6:
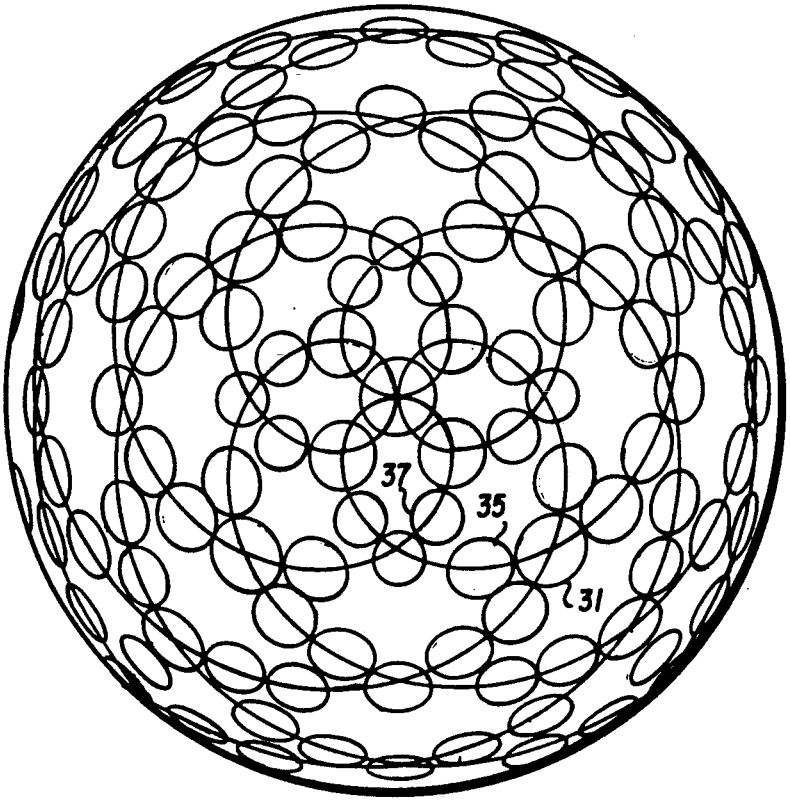
FIG. 6 is a polar view of the ball of FIG. 5 modified by using different dimple sizes to avoid intersecting dimples.

Turning to FIG. 6, it can be seen that one solution for eliminating the overlaps while still striving towards the coverage of the surface is to use dimples having different sizes. In this particular embodiment three different size dimples are used. The largest dimples 31 are of the diameter with which the method began, with the smaller dimples 35 and yet smaller dimples 37 being also used. FIG. 6 discloses the use of such dimples along the arcs so as to eliminate overlapping of any of the dimples.

It is noted that each of the clockwise arcs may include the identical pattern of dimples, including number, size, and location. Likewise, each of the counterclockwise arcs may include the identical pattern of dimples, including number, size, and location. This provides the symmetry which is discussed above.

Figure 7:
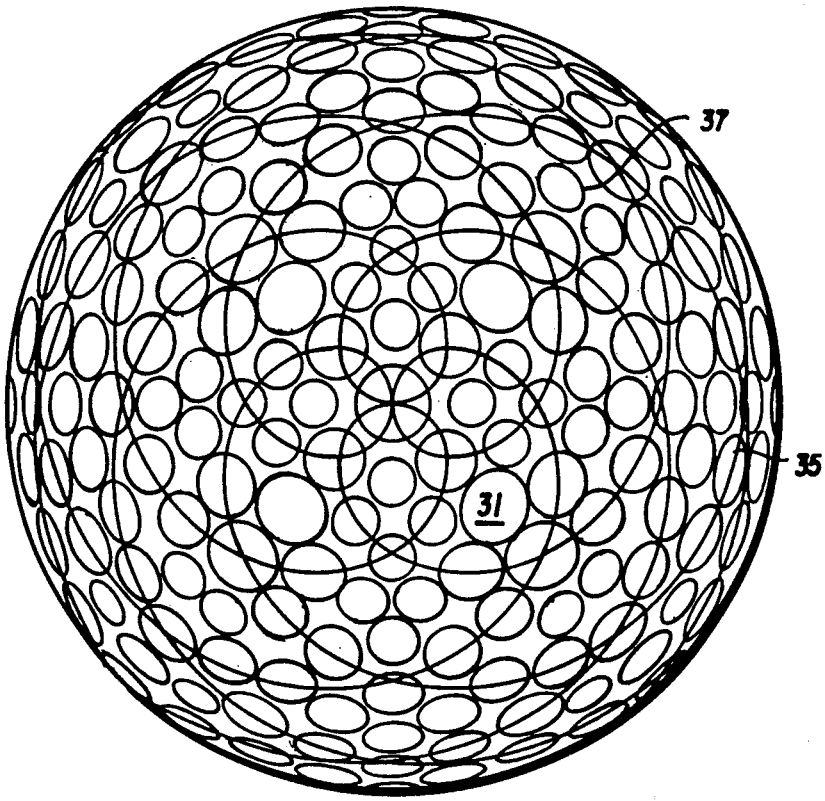
FIG. 7 is a polar view of the ball of FIG. 6 with further dimples of different sizes being placed in the area between the dimples forming the arcuate lines.

The same criterion of maximum dimple coverage is used to complete the ball. FIG. 7 illustrates the use of dimples of three different sizes within the areas between the dimples which lie along the arcuate lines.

Figure 8:
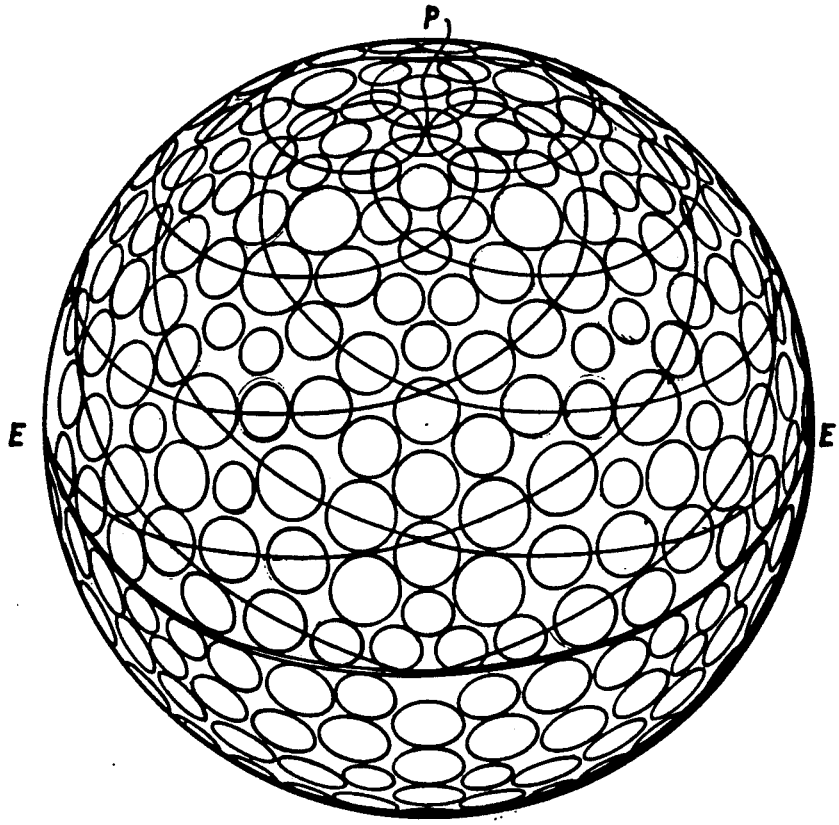
FIG. 8 is an offset view of FIG. 7.

FIG. 8 is a view taken along an offset line from the equator showing the same dimple arrangement as FIG. 7.

Figure 9:
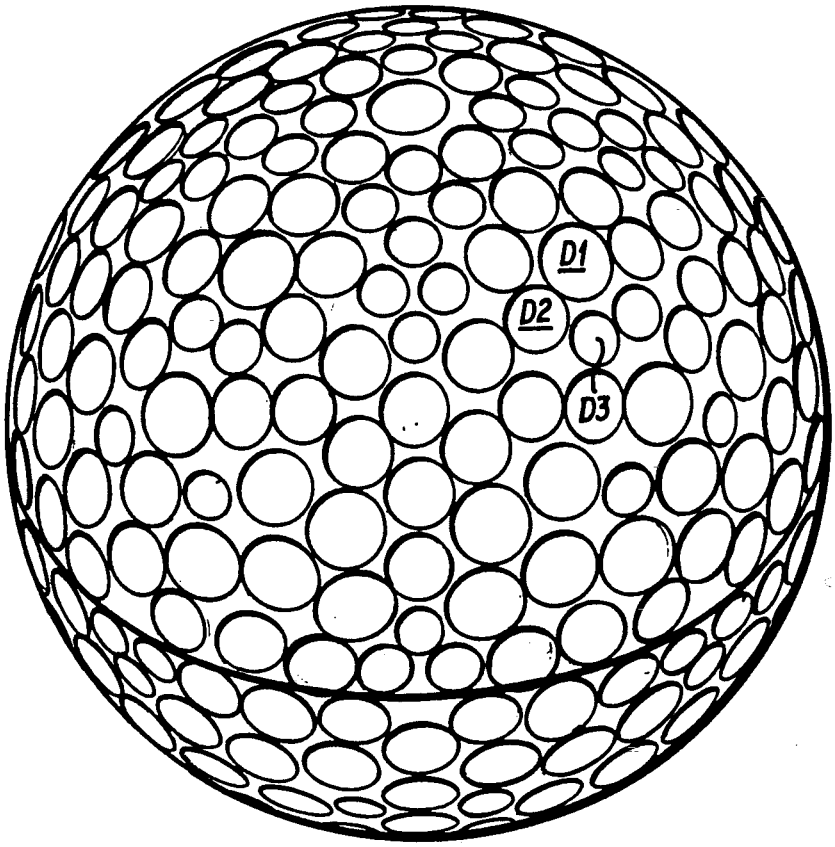
FIG. 9 is a view taken along an offset line from the equator line of the ball showing the finished ball without the arcuate lines thereon.

FIG. 9 is a showing of the ball of FIG. 8 without any arcuate lines.

In the particular embodiment shown in FIGS. 2–9, three different size dimples are used. The dimples have the following diameters D and depths d:

| | |
|---|---|
| D1 = 0.165 Inch | d1 = 0.0113 Inch |
| D2 = 0.140 Inch | d2 = 0.0099 Inch |
| D3 = 0.110 Inch | d3 = 0.0076 Inch |

FIG. 19 illustrates the standard measurement technique for dimple diameter and depth.

As will be evident from viewing the drawings, the adjustment of the dimples not only relates to using dimples of different diameters, but also to small adjustments of the location of the center of the dimples.

It should be noted that if a particular configuration of dimples is not within acceptable standards relative to aerodynamic symmetry, it is common practice to make minor modifications in dimple location and dimple depth without departing from the basic dimple pattern.

The ball of the embodiment shown in FIG. 9 is based on the four sets of opposed clockwise and counterclockwise arcs, with each arc being substantially helical and extending 360° about the hemisphere between the pole and the equator. There are a total of 410 dimples, with 138 dimples having a diameter D1, 160 dimples having a diameter D2, and 112 dimples having a diameter D3. Each arc includes a common polar dimple D1, eight additional dimples having a diameter D1, nine dimples having a diameter D2, and two dimples having a diameter D3. As can be seen, each of the arcs share one dimple at the point of intersection of any two arcs. The hemispherical coordinates and the diameter of each dimple are indicated in the following chart:

| DIMPLE | LATITUDE | | | LONGITUDE | | | DIMPLE |
|---|---|---|---|---|---|---|---|
| NUMBER | Degrees | Minutes | Seconds | Degrees | Minutes | Second | DIAMETER |
| 1 | 0 | 0 | 0 | 0 | 0 | 0 | 0.165 |
| 2 | 11 | 53 | 30 | 0 | 0 | 0 | 0.110 |
| 3 | 11 | 53 | 30 | 45 | 0 | 0 | 0.140 |
| 4 | 11 | 53 | 30 | 90 | 0 | 0 | 0.110 |
| 5 | 11 | 53 | 30 | 135 | 0 | 0 | 0.140 |
| 6 | 11 | 53 | 30 | 180 | 0 | 0 | 0.110 |
| 7 | 11 | 53 | 30 | 225 | 0 | 0 | 0.140 |
| 8 | 11 | 53 | 30 | 270 | 0 | 0 | 0.110 |
| 9 | 11 | 53 | 30 | 315 | 0 | 0 | 0.140 |
| 10 | 18 | 32 | 0 | 19 | 6 | 45 | 0.110 |
| 11 | 18 | 32 | 0 | 70 | 53 | 15 | 0.110 |
| 12 | 18 | 32 | 0 | 109 | 6 | 45 | 0.110 |
| 13 | 18 | 32 | 0 | 160 | 53 | 15 | 0.110 |
| 14 | 18 | 32 | 0 | 199 | 6 | 45 | 0.110 |
| 15 | 18 | 32 | 0 | 250 | 53 | 15 | 0.110 |
| 16 | 18 | 32 | 0 | 289 | 6 | 45 | 0.110 |
| 17 | 18 | 32 | 0 | 340 | 53 | 15 | 0.110 |
| 18 | 22 | 24 | 0 | 45 | 0 | 0 | 0.165 |
| 19 | 22 | 24 | 0 | 135 | 0 | 0 | 0.165 |

-continued

| DIMPLE NUMBER | LATITUDE Degrees | Minutes | Seconds | LONGITUDE Degrees | Minutes | Second | DIMPLE DIAMETER |
|---|---|---|---|---|---|---|---|
| 20 | 22 | 24 | 0 | 225 | 0 | 0 | 0.165 |
| 21 | 22 | 24 | 0 | 315 | 0 | 0 | 0.165 |
| 22 | 23 | 27 | 45 | 0 | 0 | 0 | 0.110 |
| 23 | 23 | 27 | 45 | 90 | 0 | 0 | 0.110 |
| 24 | 23 | 27 | 45 | 180 | 0 | 0 | 0.110 |
| 25 | 23 | 27 | 45 | 270 | 0 | 0 | 0.110 |
| 26 | 28 | 45 | 15 | 25 | 39 | 0 | 0.140 |
| 27 | 28 | 45 | 15 | 64 | 21 | 0 | 0.140 |
| 28 | 28 | 45 | 15 | 115 | 39 | 0 | 0.140 |
| 29 | 28 | 45 | 15 | 154 | 21 | 0 | 0.140 |
| 30 | 28 | 45 | 15 | 205 | 39 | 0 | 0.140 |
| 31 | 28 | 45 | 15 | 244 | 21 | 0 | 0.140 |
| 32 | 28 | 45 | 15 | 295 | 39 | 0 | 0.140 |
| 33 | 28 | 45 | 15 | 334 | 21 | 0 | 0.140 |
| 34 | 30 | 53 | 45 | 8 | 17 | 0 | 0.110 |
| 35 | 30 | 53 | 45 | 81 | 43 | 0 | 0.110 |
| 36 | 30 | 53 | 45 | 98 | 17 | 0 | 0.110 |
| 37 | 30 | 53 | 45 | 171 | 43 | 0 | 0.110 |
| 38 | 30 | 53 | 45 | 188 | 17 | 0 | 0.110 |
| 39 | 30 | 53 | 45 | 261 | 43 | 0 | 0.110 |
| 40 | 30 | 53 | 45 | 278 | 17 | 0 | 0.110 |
| 41 | 30 | 53 | 45 | 351 | 43 | 0 | 0.110 |
| 42 | 33 | 55 | 45 | 45 | 0 | 0 | 0.165 |
| 43 | 33 | 55 | 45 | 135 | 0 | 0 | 0.165 |
| 44 | 33 | 55 | 45 | 225 | 0 | 0 | 0.165 |
| 45 | 33 | 55 | 45 | 315 | 0 | 0 | 0.165 |
| 46 | 37 | 40 | 15 | 0 | 0 | 0 | 0.110 |
| 47 | 37 | 40 | 15 | 90 | 0 | 0 | 0.110 |
| 48 | 37 | 40 | 15 | 180 | 0 | 0 | 0.110 |
| 49 | 37 | 40 | 15 | 270 | 0 | 0 | 0.110 |
| 50 | 38 | 13 | 15 | 28 | 43 | 0 | 0.140 |
| 51 | 38 | 13 | 15 | 61 | 17 | 0 | 0.140 |
| 52 | 38 | 13 | 15 | 118 | 43 | 0 | 0.140 |
| 53 | 38 | 13 | 15 | 151 | 17 | 0 | 0.140 |
| 54 | 38 | 13 | 15 | 208 | 43 | 0 | 0.140 |
| 55 | 38 | 13 | 15 | 241 | 17 | 0 | 0.140 |
| 56 | 38 | 13 | 15 | 298 | 43 | 0 | 0.140 |
| 57 | 38 | 13 | 15 | 331 | 17 | 0 | 0.140 |
| 58 | 41 | 7 | 30 | 13 | 57 | 0 | 0.140 |
| 59 | 41 | 7 | 30 | 76 | 3 | 0 | 0.140 |
| 60 | 41 | 7 | 30 | 103 | 57 | 0 | 0.140 |
| 61 | 41 | 7 | 30 | 166 | 3 | 0 | 0.140 |
| 62 | 41 | 7 | 30 | 193 | 57 | 0 | 0.140 |
| 63 | 41 | 7 | 30 | 256 | 3 | 0 | 0.140 |
| 64 | 41 | 7 | 30 | 283 | 57 | 0 | 0.140 |
| 65 | 41 | 7 | 30 | 346 | 3 | 0 | 0.140 |
| 66 | 44 | 31 | 0 | 39 | 0 | 15 | 0.110 |
| 67 | 44 | 31 | 0 | 50 | 59 | 45 | 0.110 |
| 68 | 44 | 31 | 0 | 129 | 0 | 15 | 0.110 |
| 69 | 44 | 31 | 0 | 140 | 59 | 45 | 0.110 |
| 70 | 44 | 31 | 0 | 219 | 0 | 15 | 0.110 |
| 71 | 44 | 31 | 0 | 230 | 59 | 45 | 0.110 |
| 72 | 44 | 31 | 0 | 309 | 0 | 15 | 0.110 |
| 73 | 44 | 31 | 0 | 320 | 59 | 45 | 0.110 |
| 74 | 47 | 47 | 15 | 0 | 0 | 0 | 0.140 |
| 75 | 47 | 47 | 15 | 90 | 0 | 0 | 0.140 |
| 76 | 47 | 47 | 15 | 180 | 0 | 0 | 0.140 |
| 77 | 47 | 47 | 15 | 270 | 0 | 0 | 0.140 |
| 78 | 49 | 27 | 0 | 21 | 28 | 45 | 0.140 |
| 79 | 49 | 27 | 0 | 68 | 31 | 15 | 0.140 |
| 80 | 49 | 27 | 0 | 111 | 28 | 45 | 0.140 |
| 81 | 49 | 27 | 0 | 158 | 31 | 15 | 0.140 |
| 82 | 49 | 27 | 0 | 201 | 28 | 45 | 0.140 |
| 83 | 49 | 27 | 0 | 248 | 31 | 15 | 0.140 |
| 84 | 49 | 27 | 0 | 291 | 28 | 45 | 0.140 |
| 85 | 49 | 27 | 0 | 338 | 31 | 15 | 0.140 |
| 86 | 52 | 21 | 45 | 33 | 13 | 15 | 0.140 |
| 87 | 52 | 21 | 45 | 56 | 46 | 45 | 0.140 |
| 88 | 52 | 21 | 45 | 123 | 13 | 15 | 0.140 |
| 89 | 52 | 21 | 45 | 146 | 46 | 45 | 0.140 |
| 90 | 52 | 21 | 45 | 213 | 13 | 15 | 0.140 |
| 91 | 52 | 21 | 45 | 236 | 46 | 45 | 0.140 |
| 92 | 52 | 21 | 45 | 303 | 13 | 15 | 0.140 |
| 93 | 52 | 21 | 45 | 326 | 46 | 45 | 0.140 |
| 94 | 53 | 51 | 30 | 10 | 14 | 15 | 0.140 |
| 95 | 53 | 51 | 30 | 79 | 45 | 45 | 0.140 |
| 96 | 53 | 51 | 30 | 100 | 14 | 15 | 0.140 |
| 97 | 53 | 51 | 30 | 169 | 45 | 45 | 0.140 |
| 98 | 53 | 51 | 30 | 190 | 14 | 15 | 0.140 |
| 99 | 53 | 51 | 30 | 259 | 45 | 45 | 0.140 |

-continued

| DIMPLE NUMBER | LATITUDE Degrees | Minutes | Seconds | LONGITUDE Degrees | Minutes | Second | DIMPLE DIAMETER |
|---|---|---|---|---|---|---|---|
| 100 | 53 | 51 | 30 | 280 | 14 | 15 | 0.140 |
| 101 | 53 | 51 | 30 | 349 | 45 | 45 | 0.140 |
| 102 | 56 | 28 | 15 | 45 | 0 | 0 | 0.165 |
| 103 | 56 | 28 | 15 | 135 | 0 | 0 | 0.165 |
| 104 | 56 | 28 | 15 | 225 | 0 | 0 | 0.165 |
| 105 | 56 | 28 | 15 | 315 | 0 | 0 | 0.165 |
| 106 | 58 | 51 | 0 | 0 | 0 | 0 | 0.140 |
| 107 | 58 | 51 | 0 | 90 | 0 | 0 | 0.140 |
| 108 | 58 | 51 | 0 | 180 | 0 | 0 | 0.140 |
| 109 | 58 | 51 | 0 | 270 | 0 | 0 | 0.140 |
| 110 | 61 | 8 | 30 | 24 | 2 | 0 | 0.165 |
| 111 | 61 | 8 | 30 | 65 | 58 | 0 | 0.165 |
| 112 | 61 | 8 | 30 | 114 | 2 | 0 | 0.165 |
| 113 | 61 | 8 | 30 | 155 | 58 | 0 | 0.165 |
| 114 | 61 | 8 | 30 | 204 | 2 | 0 | 0.165 |
| 115 | 61 | 8 | 30 | 245 | 58 | 0 | 0.165 |
| 116 | 61 | 8 | 30 | 294 | 2 | 0 | 0.165 |
| 117 | 61 | 8 | 30 | 335 | 58 | 0 | 0.165 |
| 118 | 64 | 13 | 0 | 11 | 20 | 30 | 0.165 |
| 119 | 64 | 13 | 0 | 78 | 39 | 30 | 0.165 |
| 120 | 64 | 13 | 0 | 101 | 20 | 30 | 0.165 |
| 121 | 64 | 13 | 0 | 168 | 39 | 30 | 0.165 |
| 122 | 64 | 13 | 0 | 191 | 20 | 30 | 0.165 |
| 123 | 64 | 13 | 0 | 258 | 39 | 30 | 0.165 |
| 124 | 64 | 13 | 0 | 281 | 20 | 30 | 0.165 |
| 125 | 64 | 13 | 0 | 348 | 39 | 30 | 0.165 |
| 126 | 65 | 4 | 15 | 34 | 34 | 15 | 0.110 |
| 127 | 65 | 4 | 15 | 55 | 25 | 45 | 0.110 |
| 128 | 65 | 4 | 15 | 124 | 34 | 15 | 0.110 |
| 129 | 65 | 4 | 15 | 145 | 25 | 45 | 0.110 |
| 130 | 65 | 4 | 15 | 214 | 34 | 15 | 0.110 |
| 131 | 65 | 4 | 15 | 235 | 25 | 45 | 0.110 |
| 132 | 65 | 4 | 15 | 304 | 34 | 15 | 0.110 |
| 133 | 65 | 4 | 15 | 325 | 25 | 45 | 0.110 |
| 134 | 67 | 50 | 15 | 45 | 0 | 0 | 0.165 |
| 135 | 67 | 50 | 15 | 135 | 0 | 0 | 0.165 |
| 136 | 67 | 50 | 15 | 225 | 0 | 0 | 0.165 |
| 137 | 67 | 50 | 15 | 315 | 0 | 0 | 0.165 |
| 138 | 69 | 25 | 30 | 0 | 0 | 0 | 0.140 |
| 139 | 69 | 25 | 30 | 90 | 0 | 0 | 0.140 |
| 140 | 69 | 25 | 30 | 180 | 0 | 0 | 0.140 |
| 141 | 69 | 25 | 30 | 270 | 0 | 0 | 0.140 |
| 142 | 72 | 42 | 30 | 21 | 18 | 0 | 0.165 |
| 143 | 72 | 42 | 30 | 68 | 42 | 0 | 0.165 |
| 144 | 72 | 42 | 30 | 111 | 18 | 0 | 0.165 |
| 145 | 72 | 42 | 30 | 158 | 42 | 0 | 0.165 |
| 146 | 72 | 42 | 30 | 201 | 18 | 0 | 0.165 |
| 147 | 72 | 42 | 30 | 248 | 42 | 0 | 0.165 |
| 148 | 72 | 42 | 30 | 291 | 18 | 0 | 0.165 |
| 149 | 72 | 42 | 30 | 338 | 42 | 0 | 0.165 |
| 150 | 74 | 42 | 0 | 33 | 5 | 0 | 0.165 |
| 151 | 74 | 42 | 0 | 56 | 55 | 0 | 0.165 |
| 152 | 74 | 42 | 0 | 123 | 5 | 0 | 0.165 |
| 153 | 74 | 42 | 0 | 146 | 55 | 0 | 0.165 |
| 154 | 74 | 42 | 0 | 213 | 5 | 0 | 0.165 |
| 155 | 74 | 42 | 0 | 236 | 55 | 0 | 0.165 |
| 156 | 74 | 42 | 0 | 303 | 5 | 0 | 0.165 |
| 157 | 74 | 42 | 0 | 326 | 55 | 0 | 0.165 |
| 158 | 75 | 34 | 0 | 9 | 26 | 30 | 0.165 |
| 159 | 75 | 34 | 0 | 80 | 33 | 30 | 0.165 |
| 160 | 75 | 34 | 0 | 99 | 26 | 30 | 0.165 |
| 161 | 75 | 34 | 0 | 170 | 33 | 30 | 0.165 |
| 162 | 75 | 34 | 0 | 189 | 26 | 30 | 0.165 |
| 163 | 75 | 34 | 0 | 260 | 33 | 30 | 0.165 |
| 164 | 75 | 34 | 0 | 279 | 26 | 30 | 0.165 |
| 165 | 75 | 34 | 0 | 350 | 33 | 30 | 0.165 |
| 166 | 79 | 8 | 15 | 45 | 0 | 0 | 0.165 |
| 167 | 79 | 8 | 15 | 135 | 0 | 0 | 0.165 |
| 168 | 79 | 8 | 15 | 225 | 0 | 0 | 0.165 |
| 169 | 79 | 8 | 15 | 315 | 0 | 0 | 0.165 |
| 170 | 79 | 18 | 0 | 0 | 0 | 0 | 0.110 |
| 171 | 79 | 18 | 0 | 90 | 0 | 0 | 0.110 |
| 172 | 79 | 18 | 0 | 180 | 0 | 0 | 0.110 |
| 173 | 79 | 18 | 0 | 270 | 0 | 0 | 0.110 |
| 174 | 83 | 47 | 15 | 24 | 36 | 45 | 0.165 |
| 175 | 83 | 47 | 15 | 65 | 23 | 15 | 0.165 |
| 176 | 83 | 47 | 15 | 114 | 36 | 45 | 0.165 |
| 177 | 83 | 47 | 15 | 155 | 23 | 15 | 0.165 |
| 178 | 83 | 47 | 15 | 204 | 36 | 45 | 0.165 |
| 179 | 83 | 47 | 15 | 245 | 23 | 15 | 0.165 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Second | DIAMETER |
| 180 | 83 | 47 | 15 | 294 | 36 | 45 | 0.165 |
| 181 | 83 | 47 | 15 | 335 | 23 | 15 | 0.165 |
| 182 | 84 | 46 | 45 | 35 | 54 | 15 | 0.140 |
| 183 | 84 | 46 | 45 | 54 | 5 | 45 | 0.140 |
| 184 | 84 | 46 | 45 | 125 | 54 | 15 | 0.140 |
| 185 | 84 | 46 | 45 | 144 | 5 | 45 | 0.140 |
| 186 | 84 | 46 | 45 | 215 | 54 | 15 | 0.140 |
| 187 | 84 | 46 | 45 | 234 | 5 | 45 | 0.140 |
| 188 | 84 | 46 | 45 | 305 | 54 | 15 | 0.140 |
| 189 | 84 | 46 | 45 | 324 | 5 | 45 | 0.140 |
| 190 | 85 | 0 | 15 | 14 | 6 | 30 | 0.140 |
| 191 | 85 | 0 | 15 | 75 | 53 | 30 | 0.140 |
| 192 | 85 | 0 | 15 | 104 | 6 | 30 | 0.140 |
| 193 | 85 | 0 | 15 | 165 | 53 | 30 | 0.140 |
| 194 | 85 | 0 | 15 | 194 | 6 | 30 | 0.140 |
| 195 | 85 | 0 | 15 | 255 | 53 | 30 | 0.140 |
| 196 | 85 | 0 | 15 | 284 | 6 | 30 | 0.140 |
| 197 | 85 | 0 | 15 | 345 | 53 | 30 | 0.140 |
| 198 | 85 | 39 | 15 | 4 | 54 | 15 | 0.110 |
| 199 | 85 | 39 | 15 | 85 | 5 | 45 | 0.110 |
| 200 | 85 | 39 | 15 | 94 | 54 | 15 | 0.110 |
| 201 | 85 | 39 | 15 | 175 | 5 | 45 | 0.110 |
| 202 | 85 | 39 | 15 | 184 | 54 | 15 | 0.110 |
| 203 | 85 | 39 | 15 | 265 | 5 | 45 | 0.110 |
| 204 | 85 | 39 | 15 | 274 | 54 | 15 | 0.110 |
| 205 | 85 | 39 | 15 | 355 | 5 | 45 | 0.110 |

In order to further enhance the aerodynamic symmetry of the golf ball, the opposed hemispheres may be rotated relative to each other about an axis extending through the poles of the hemispheres. In the embodiment illustrated in FIG. 9, these hemispheres have been rotated 45°. The desired optimum rotation will depend primarily upon how many sets of arcs are used.

The ball described in FIGS. 1–9 has been tested and meets U.S.G.A. requirements relative to aerodynamic symmetry.

In order to obtain the proper results, at least two sets of opposed clockwise and counterclockwise arcs must be used. The number of sets used may be varied, however, and still obtain the same desired aerodynamically symmetrical results. Additionally, the arcs could extend less than or more than 360° and still provide practical data lines and points for the proper placement of dimples. It should be further noted that the diameter of the dimples is not limited to three different diameters, but may be varied in a manner which is considered to be desirable. Obviously, different configurations using different diameter dimples may be used in order to provide a greater surface coverage; but use of the same diameter dimples will result in a useable ball.

The embodiments shown in FIGS. 10–18 disclose different arc configurations. For clarity purposes, the dimples are not shown on these configurations; but the placement of such dimples would be obvious when following the method previously described relative to the ball of FIGS. 1–9. It is also to be understood that the disclosed configurations are not to be considered as limiting the invention, but merely as examples of various embodiments which may be used under the invention.

Figure 10:
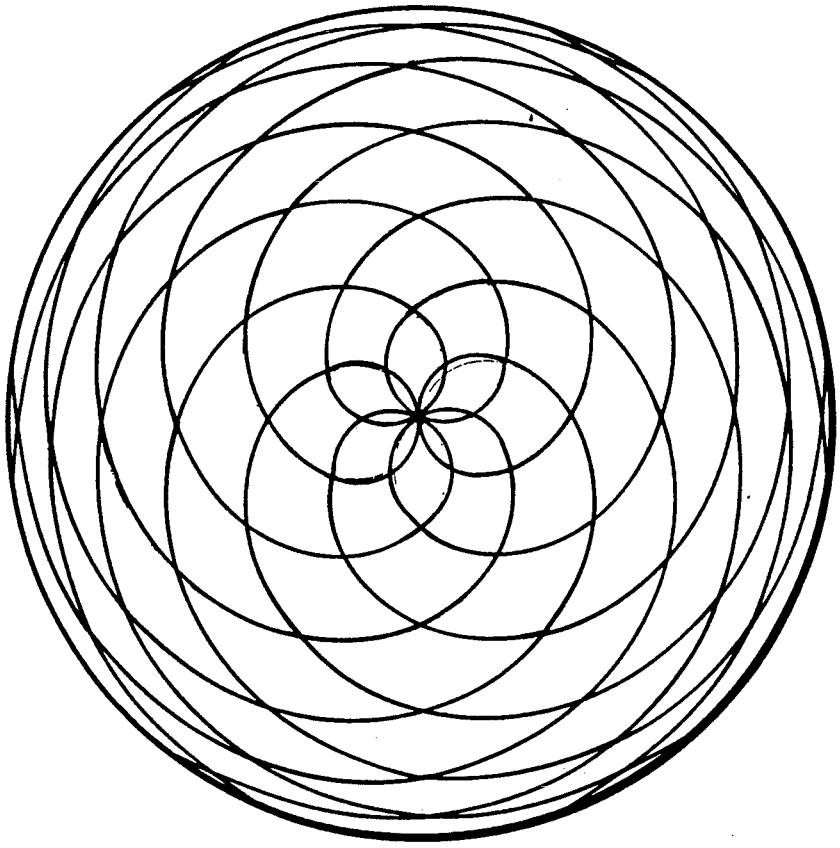

FIG. 10 discloses a configuration using six sets of clockwise and counterclockwise arcs which extend 360° between the pole and the equator.

FIG. 11 discloses a configuration using seven sets of opposed clockwise and counterclockwise arcs, with each arc extending 270° between the pole and the equator.

FIG. 12 discloses a configuration using five sets of opposed clockwise and counterclockwise arcs which extend 270° between the pole and the equator.

Figure 13:
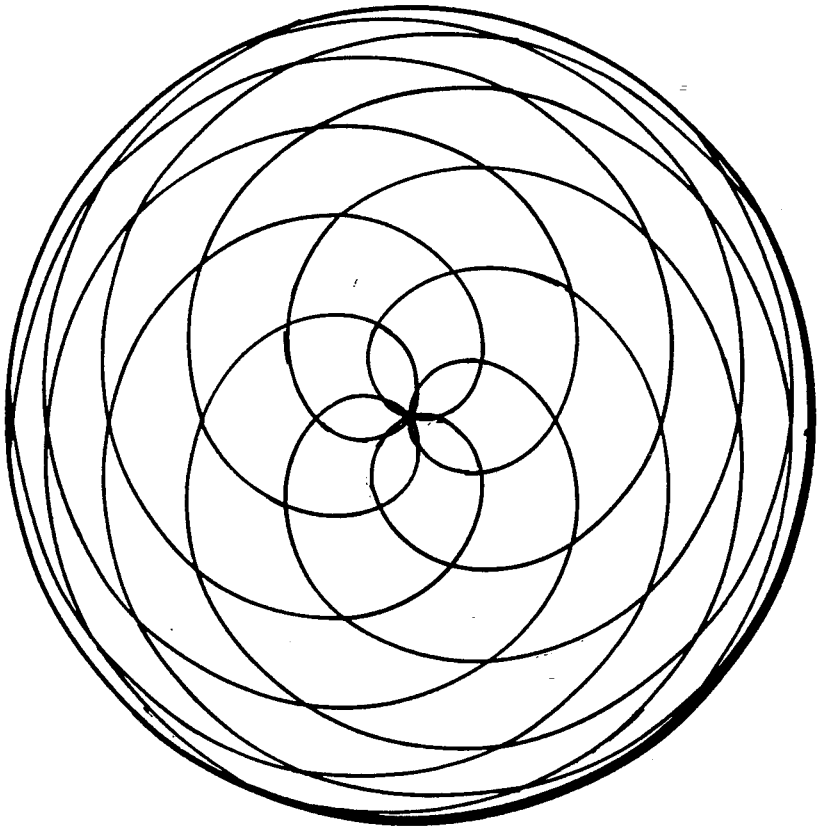

FIG. 13 discloses a configuration using five sets of opposed clockwise and counterclockwise arcs which extend 360° between the pole and the equator.

Figure 14:
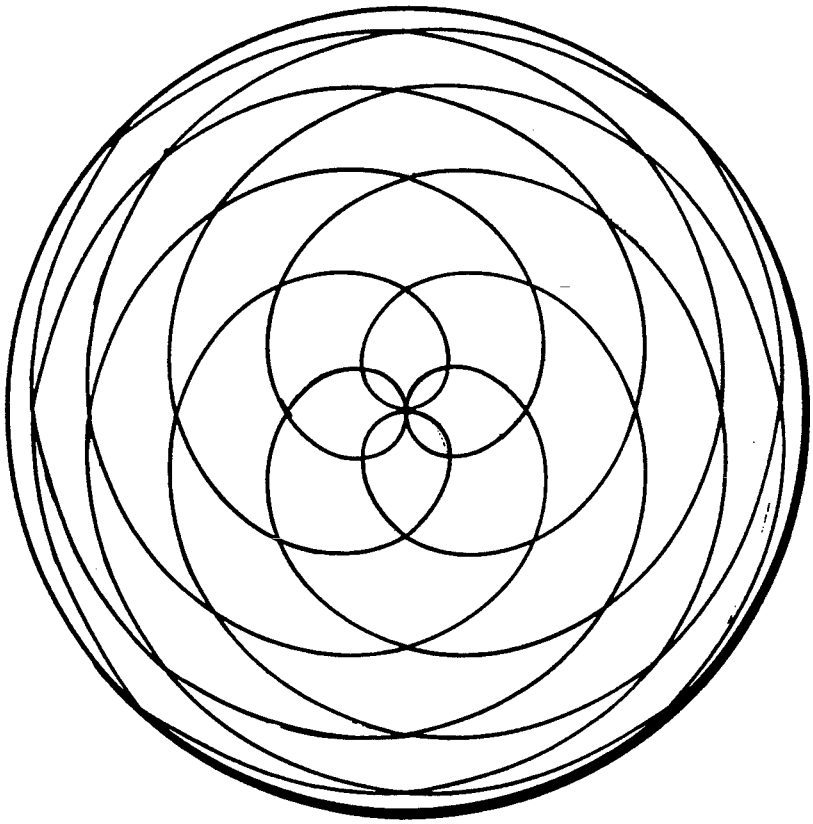

FIG. 14 discloses a configuration using four sets of opposed clockwise and counterclockwise arcs extending 450° between the pole and the equator.

Figure 15:
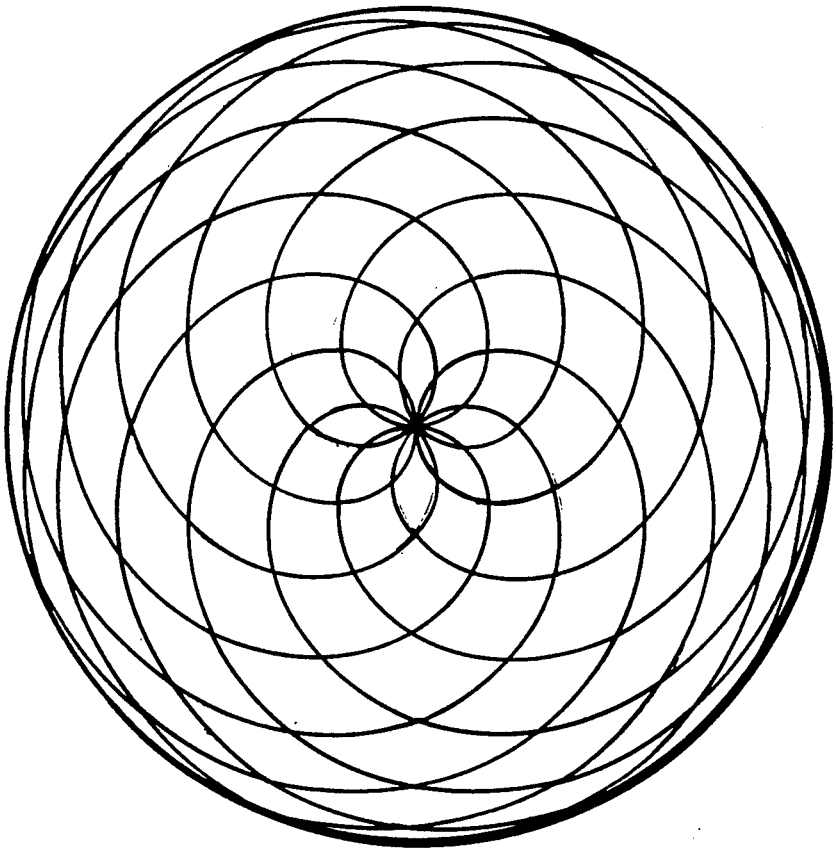

FIG. 15 discloses a configuration having eight sets of opposed clockwise and counterclockwise arcs extending 270° between the pole and the equator.

Figure 16:
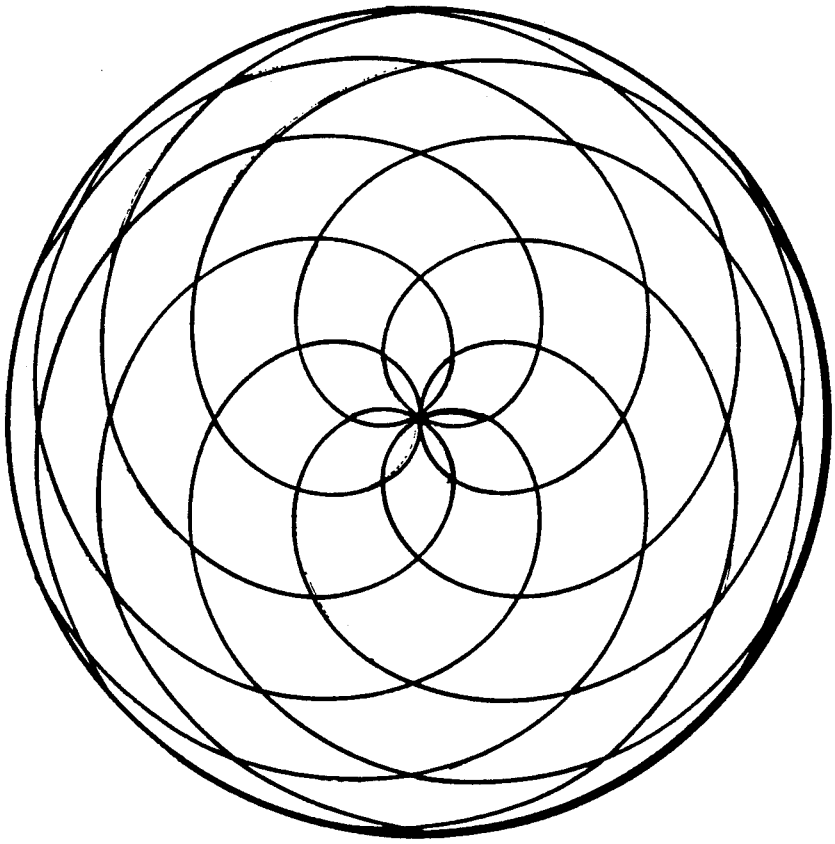

FIG. 16 discloses a configuration having six sets of opposed clockwise and counterclockwise arcs extending 270° between the pole and the equator.

FIG. 17 discloses a configuration having three sets of opposed clockwise and counterclockwise arcs extending 450° between the pole and the equator.

FIG. 18 discloses a configuration having three sets of opposed clockwise and counterclockwise arcs extending 540° between the pole and the equator.

It is to be understood the above description and drawings are illustrative only since modifications could be made without departing from the invention, the scope of which is to be limited only by the following claims.

We claim:

1. A golf ball having a dimpled surface, the configuration of said dimpled surface comprising a dimple-free equatorial line on said ball dividing said ball into two hemispheres with each hemisphere having a pole and substantially identical dimple patterns, each hemispherical dimple pattern comprising at least two spaced imaginary arcs extending clockwise between said pole and said equator on said surface;

at least two spaced imaginary arcs extending counterclockwise between said pole and said equator on said surface;

a plurality of dimples extending along each of said arcs between said pole and said equator; and a second plurality of dimples substantially filling the surface area enclosed within said arcs.

2. The golf ball of claim 1 wherein each of said clockwise arcs has the same number of dimples and each of said counterclockwise arcs have the same number of dimples.

3. The golf ball of claim 1 wherein each of said arcs terminates at one end within a common polar dimple.

4. The golf ball of claim 1 wherein a dimple is located substantially at each point on the surface of said hemisphere where said clockwise arcs cross said counterclockwise arcs.

5. The golf ball of claim 1 wherein said dimples are of at least two different diameters.

6. The golf ball of claim 5 wherein each of said clockwise arcs has the same dimple configuration and each of said counterclockwise arcs has the same dimple configuration.

7. The golf ball of claim 1 wherein said arcs are helices.

8. The golf ball of claim 1 wherein each of said arcs on said hemisphere extends substantially 360° about the hemisphere between the pole and the equator.

9. The golf ball of claim 1 wherein each of said arcs on said hemisphere extends less than 360° about the hemisphere between the pole and the equator.

10. The golf ball of claim 1 wherein each of said arcs on said hemisphere extends more than 360° about the hemisphere between the pole and the equator.

11. The golf ball of claim 1 wherein none of said dimples overlap each other.

12. The golf ball of claim 1 wherein said two hemispheres are rotated with respect to each other a predetermined degree about an axis through the said poles.

13. A method of locating dimples on the surface of a golf ball comprising designating opposite pole locations and an equator between said poles to create two equal hemispheres;

establishing at least two arcs extending clockwise between said pole and said equator on the surface of each of said hemispheres;

establishing at least two arcs extending counterclockwise between said pole and said equator on the surface of each of said hemispheres;

locating a plurality of dimples along said arcs; and substantially filling the area within said arcs with dimples, the total number of said dimples being the same for both hemispheres.

14. The method of claim 13 wherein each of said arcs terminates in a common polar dimple.

15. The method of claim 13 further comprising locating a dimple substantially at each point where said clockwise and counterclockwise arcs intersect.

16. The method of claim 13 wherein said arcs are helices.

17. The method of claim 13 wherein said arcs on the surface of said hemispheres extend substantially 360° between said poles and said equator.

18. The method of claim 13 wherein said arcs on the surface of said hemispheres extend less than 360° between said poles and said equator.

19. The method of claim 13 wherein said arcs on the surface of said hemispheres extend more than 360° between said pole and said equator.

20. The method of claim 13 wherein said dimples are of at least two different diameters.

21. The method of claim 13 wherein none of said dimples overlap each other.

22. A golf ball having a dimpled surface with a dimple-free equatorial line dividing the ball into two hemispheres, each hemisphere having a pole, each of said hemispherical dimpled surfaces comprising a first plurality of dimples extending in at least two spaced clockwise arcs between said pole and said equator;

a second plurality of dimples extending in at least two spaced counterclockwise arcs between said pole and said equator; and a third plurality of dimples substantially filling the surface area between said first and second plurality of dimples.

23. The golf ball of claim 22 wherein a dimple is located substantially at each point on said surface of said hemisphere where said clockwise arcs cross said counterclockwise arcs.

24. The golf ball of claim 22 wherein said clockwise and counterclockwise arcs are helical.

25. The golf ball of claim 22 wherein said clockwise arcs and said counterclockwise arcs in each of said hemispheres extend substantially 360° between said pole and said equator.

26. The golf ball of claim 22 wherein said first, second, and third pluralities of dimples are comprised of dimples which are of at least two different diameters.

27. The golf ball of claim 22 wherein each of said pluralities of dimples extending in a clockwise arc has the same number of dimples and each of said pluralities of dimples extending in a counterclockwise arc has the same number of dimples.

28. The golf ball of claim 22 wherein each of said clockwise and counterclockwise arcs terminate at one end in a common polar dimple.

29. The golf ball of claim 22 wherein said arcs are helices.

30. The golf ball of claim 22 wherein said clockwise and counterclockwise arcs extend more than 360° between said pole and said equator.

31. The golf ball of claim 22 wherein said clockwise and counterclockwise arcs extend less than 360° between said pole and said equator.

32. A golf ball having a dimpled surface with a dimple-free equatorial line dividing the ball into two hemispheres, each hemisphere having a pole, each of said hemispherical surfaces comprising a first plurality of dimples extending in four spaced clockwise arcs between said pole and said equator, said plurality of dimples comprising dimples having different diameters D1, D2, and D3;

a second plurality of dimples extending in four spaced counterclockwise arcs between said pole and said equator, said plurality of dimples having different diameters D1, D2, and D3;

a third plurality of dimples substantially filling the surface area between said first and second plurality of dimples;

said third plurality of dimples having different diameters D1, D2, and D3.

33. The golf ball of claim 32 wherein said dimpled surface contains 410 dimples comprising 138 dimples having a diameter D1, 16 dimples having a diameter D2, and 112 Dimples having a diameter D3.

34. The golf ball of claim 33 wherein the diameter D and the depth d of said dimples are

| Dimple | Diameter (Inches) | Depth (Inches) |
|---|---|---|
| D1 | 0.165 | 0.0113 |
| D2 | 0.140 | 0.0099 |

-continued

| Dimple | Diameter (Inches) | Depth (Inches) |
|---|---|---|
| D3 | 0.110 | 0.0076 |

35. The golf ball of claim 34 wherein each of said arcs include a common pole dimple having a diameter D1;
eight additional dimples D1;
nine dimples having a diameter D2; and
two dimples having a diameter D3, each of said arcs having a common dimple at a crossing point of any two arcs.

* * * * *

UNITED STATES PATENT AND TRADEMARK OFFICE

CERTIFICATE OF CORRECTION

PATENT NO. : 5,060,953

DATED : October 29, 1991

INVENTOR(S) : Donald J. Bunger and Joseph F. Stiefel

It is certified that error appears in the above-identified patent and that said Letters Patent is hereby corrected as shown below:

Column 12, Line 67, should read:

--having a diameter D1, 160 dimples having a diameter D2,--.

Signed and Sealed this

Second Day of March, 1993

*Attest:*

STEPHEN G. KUNIN

*Attesting Officer*

*Acting Commissioner of Patents and Trademarks*